US005999791A

United States Patent [19]

Ogawa et al.

[11] Patent Number: 5,999,791

[45] Date of Patent: Dec. 7, 1999

[54] CLEANING DEVICE FOR ELECTROPHOTOGRAPHIC APPARATUS AND ELECTROPHOTOGRAPHIC APPARATUS HAVING THE SAME

[75] Inventors: Toshitaka Ogawa; Takashi Katsushiro, both of Hitachinaka, Japan

[73] Assignee: Hitachi Koki Co., Ltd., Tokyo, Japan

[21] Appl. No.: 09/108,205

[22] Filed: Jul. 1, 1998

[30] Foreign Application Priority Data

Jul. 4, 1997 [JP] Japan ..... 9-179794
Mar. 13, 1998 [JP] Japan ..... 10-062941

[51] Int. Cl.[6] ..... G03G 21/00

[52] U.S. Cl. ..... 399/354; 399/102

[58] Field of Search ..... 399/90, 98, 99, 399/102, 105, 353, 354, 103

[56] References Cited

U.S. PATENT DOCUMENTS

| | | | |
|---|---|---|---|
| 3,685,485 | 8/1972 | Kutsuwada et al. | 399/103 X |
| 4,168,901 | 9/1979 | Ito et al. | 399/103 |
| 4,338,880 | 7/1982 | Tabuchi et al. | 399/103 |
| 4,412,736 | 11/1983 | Sakamoto et al. | 399/354 |
| 4,423,950 | 1/1984 | Sagami | 399/354 |
| 5,416,572 | 5/1995 | Kolb et al. | 399/354 X |
| 5,436,713 | 7/1995 | Bigelow et al. | 399/353 |

FOREIGN PATENT DOCUMENTS 57-201280 12/1982 Japan .

*Primary Examiner*—Fred L. Braun
*Attorney, Agent, or Firm*—Antonelli, Terry, Stout & Kraus, LLP

[57] ABSTRACT

A cleaning device capable of ensuring prevention of extraneous substances, such as the toner, paper powder and so on, from releasing outside an extraneous substance removing region, and an electrophotographic apparatus having the cleaning device. The cleaning device for an electrophotographic apparatus includes an extraneous substance removing arrangement for removing extraneous substances, such as toner, paper powder and the like, from a surface of a member to be cleaned; an extraneous substance containing arrangement for collecting the extraneous substances removed by the extraneous substance removing arrangement; and a barrier forming arrangement for preventing the extraneous substances from releasing out of an extraneous substance removing region, the barrier forming arrangement being located in the extraneous substance removing region where the extraneous substance removing arrangement acts on the member to be cleaned.

7 Claims, 2 Drawing Sheets

CLEANING DEVICE FOR ELECTROPHOTOGRAPHIC APPARATUS AND ELECTROPHOTOGRAPHIC APPARATUS HAVING THE SAME

BACKGROUND OF THE INVENTION

The present invention relates to a cleaning device for removing extraneous substances, such as toner, particles of paper and the like, which have become attached onto or remain on a surface of a member to be cleaned, and to an electrophotographic apparatus having the cleaning device.

The known construction of a cleaning device for an electrophotographic apparatus, such as a typical laser printer or a copying machine, is that a cleaning brush is supported rotatably around a shaft inside a housing, a part of the cleaning brush is exposed through an opening provided in the housing, the cleaning brush exposed through the opening in the housing is caused to rub against a surface of a member to be cleaned, such as a photosensitive drum, to remove extraneous substances, such as toner and particles of paper, from the surface of the member to be cleaned.

In a cleaning device of this kind, even though the extraneous substances are at first collected into the housing of the cleaning device by the cleaning brush, part of the extraneous substances are sometimes carried by rotation of the cleaning brush and again discharged onto the photosensitive drum surface through the opening in the housing, resulting in the contamination of the inside of the machine. Therefore, it has been considered effective in preventing extraneous substances collected inside the housing from leaking into the area of the photosensitive drum by arranging an electrode at an inner surface of the housing so as to form an electric field curtain by applying a voltage to the electrode, as disclosed, for example, in Japanese Patent Application Laid-Open No. 63-3157.

If the cleaning brush could certainly scrape and collect extraneous substances, such as toner and so on, from the surface of the photosensitive drum into the inside of the housing from an extraneous substance removing region where the cleaning brush acts on the photosensitive drum, the construction disclosed in Japanese Patent Application Laid-Open No. 63-3157 would be satisfactory. However, in actual practice, it is impossible to collect all the extraneous substances into the inside of the housing in the extraneous substance removing region, and so there exist floating extraneous substances in a scraping portion between the cleaning brush and the photosensitive drum.

The floating extraneous substances flow out along the rotating photosensitive drum to attach onto a charger arranged in a downstream portion in the rotating direction of the photosensitive drum with respect to the cleaning device, or part of the floating extraneous substances again attach onto the surface of the photosensitive body. This causes contamination of the inside of the electrophotographic apparatus. Further, the toner attached onto the charger and the toner attached onto the surface of the photosensitive drum not only contaminate the inside of the electrophotographic apparatus, but cause a degradation of printing quality.

SUMMARY OF THE INVENTION

An object of the present invention is to provide an electrophotographic apparatus having a cleaning device which can solve the above-mentioned problems which are inherent in conventional devices and can certainly prevent not only extraneous substances such as the toner and paper particles which have leaked out of the inside of an extraneous substance containing means (housing), but the extraneous substances which have failed to be collected by an extraneous substance removing means (cleaning brush) in the extraneous substance removing region, from being released outside of the extraneous substance removing region.

The foregoing object of the present invention can be attained by a cleaning device for an electrophotographic apparatus comprising an extraneous substance removing means for removing extraneous substances, such as toner, paper particles and the like, from a surface of a member to be cleaned; an extraneous substance containing means for collecting the extraneous substances removed by the extraneous substance removing means; and barrier forming means for preventing the extraneous substances from being released out of an extraneous substance removing region, located in the extraneous substance removing region where the extraneous substance removing means acts on the member to be cleaned. The extraneous substance removing means used, for example, is a cleaning brush, and the extraneous substance containing means being used is, for example, a housing, and the barrier forming means being used is, for example, a plurality of seal electrodes.

BRIEF DESCRIPTION OF THE DRAWINGS

These and other objects, features and advantages of the present invention will be understood more clearly from the following detailed description when considered with reference to the accompanying drawings, wherein.

DESCRIPTION OF THE PREFERRED EMBODIMENTS

Figure 1:
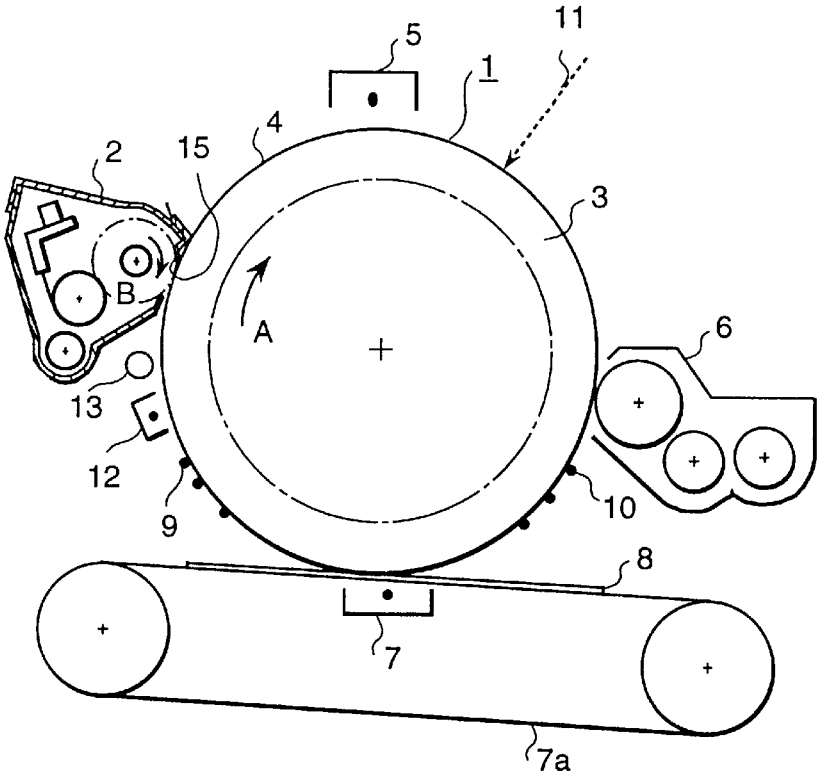
FIG. 1 is a schematic diagram showing the construction of an electrophotographic apparatus.

An embodiment of the present invention will be described below with reference to FIG. 1, FIG. 2, FIG. 3 and FIG. 4. In the figure, the reference character 1 indicates a printing portion of an electrophotographic apparatus, and the reference character 2 indicates a cleaning device. A photosensitive body 4 having a surface to be cleaned is fixed onto a surface of a cylindrical drum 3 made of aluminum, which is rotated in a direction shown by arrow A and is uniformly and negatively charged by a charger 5. Print information is printed on the photosensitive body 4 as an electrostatic latent image by a laser beam 11. A developing unit 6 frictionally charges a toner in a negative sense, and the negatively charged toner is brought into contact with the photosensitive body to attach a toner 10 onto the electrostatic latent image, and then the toner 10 is transferred onto a sheet of paper 8 by a transfer unit 7. On the surface of the photosensitive body, after transferring of the toner image, there remains a small amount of residual toner 9 which is not completely transferred to the paper 8 and remains on the photosensitive body due to an insufficient charge or the like.

The residual toner 9 is forcibly charged in a negative sense by a charger 12 and the surface electric potential of the photosensitive body is erased by a lamp 13 to allow cleaning to be performed by the cleaning device 2 more effectively in the following stage. In the cleaning device 2, a cleaning brush 21 of an extraneous substance removing means is rotatably supported via conductive bearings 26 by a housing 20, which is made of an insulating resin and forms an extraneous substance collecting means. The cleaning brush 21 is rotated in a direction shown by arrow B, that is, in a direction opposite to the direction of rotation of the photosensitive body 4, and is in contact with (scrapes) the photosensitive body where it extends through an opening 15 of the housing. The cleaning brush 21 is constructed by fixing conductive fibers having an appropriate electric resistivity around a metallic rotating shaft 25. A voltage of approximately 500 Volts is applied to the rotating shaft 25 from the main body of the apparatus through an electric supply plate, not shown in the figure. The cleaning brush 21 scrapes off the residual toner attracted to the photosensitive body 4 with an electrostatic constraint force of the photosensitive body 4, which has been weakened by being negatively charged from the photosensitive body 4 by rotating contact, and at the same time traps the residual toner by means of an electrostatic force.

The toner trapped by the cleaning brush 21 is rotated in a direction shown by an arrow C (FIG. 3) in contact with the cleaning brush 21 so as to be collected by a metallic collecting roll 22 to which a voltage of approximately 800 Volts is applied, and the collected toner is then scraped off the collecting roll 22 by a cleaning blade 23 so as to be finally discharged outside the cleaning device by operation of a collecting screw 24.

In this embodiment, seal electrodes 31 to 33 composing a barrier forming means are arranged so as to surround three sides of the opening 15. That is, the respective ends of the cleaning brush 21 are surrounded by the seal electrode 32 and the seal electrode 33 (refer to FIG. 2), and an upper side in the upstream direction of rotation of the cleaning brush 21 along the shaft direction of the rotating shaft 25 is surrounded by the seal electrode 31 (refer to FIG. 3). The seal electrode 32, being made of a metal, is thin and has an elasticity, and a part of the seal electrode is interposed between the conductive bearing 26 and the housing 20 (refer to FIG. 4). The seal electrode 32 is fixed between the housing 20 in the lower portion of the seal electrode 32 and a cover 30 made of an insulating resin in the upper portion of the seal electrode 32 through the seal electrode 31 (refer to FIG. 3).

Electric supply to the seal electrode 32 is performed by applying the same voltage as that applied to the cleaning brush 21 to the shaft 25 through the conductive bearing 26 which rotatably supports the rotating shaft 25. The seal electrode 32 and the cleaning brush 21 have a labyrinth dimension L1 (refer to FIG. 2). Particularly, in the upper portion of the upstream side of rotation of the cleaning brush 21, the labyrinth prevents the toner floating inside the cleaning device along the rotating direction of the cleaning brush 21 from leaking out of the end portion of the opening 15. That is, sometimes, a very small part of the toner scraped off from the photosensitive body by the cleaning brush 21 cannot be completely removed by the collecting roll 22 and tends to float inside the housing, but the toner can be attracted and trapped by the seal electrode 32 because the toner is negatively charged.

Figure 2:
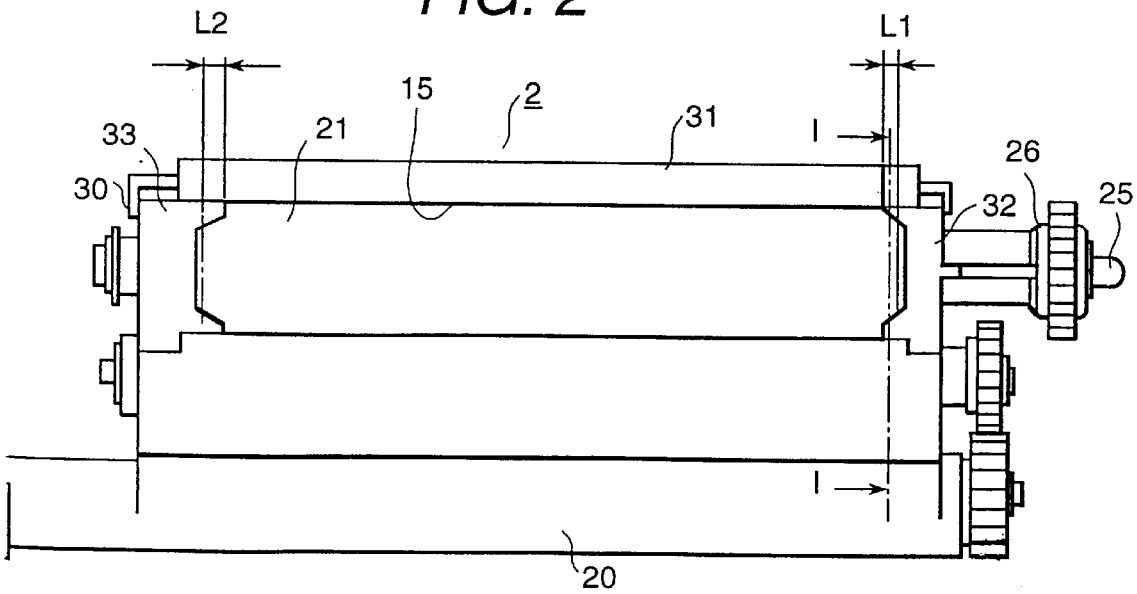
FIG. 2 is a front view showing an embodiment of a cleaning device in accordance with the present invention.
Figure 3:
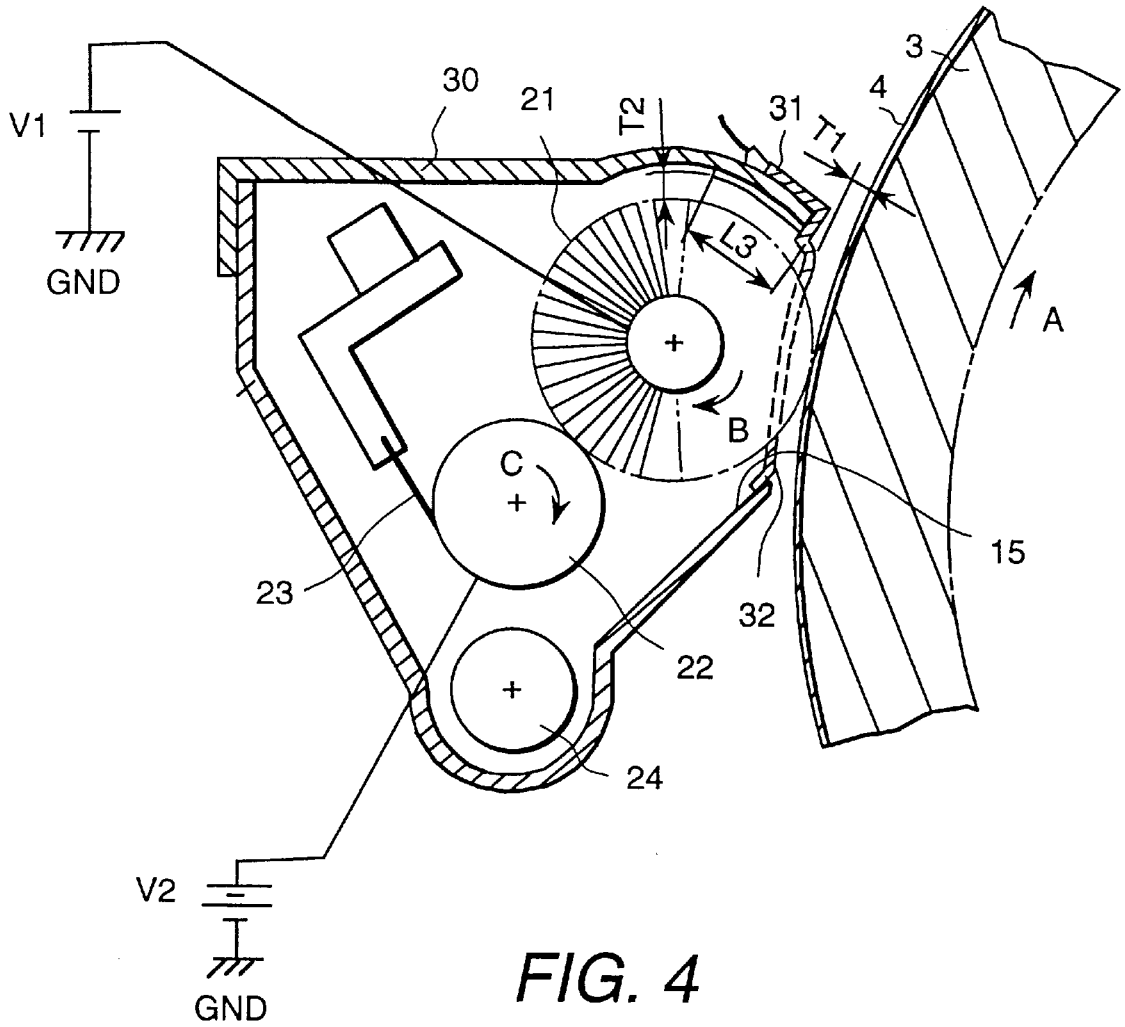
FIG. 3 is a cross-sectional view taken on the plane of the line I—I of FIG. 2.
Figure 4:
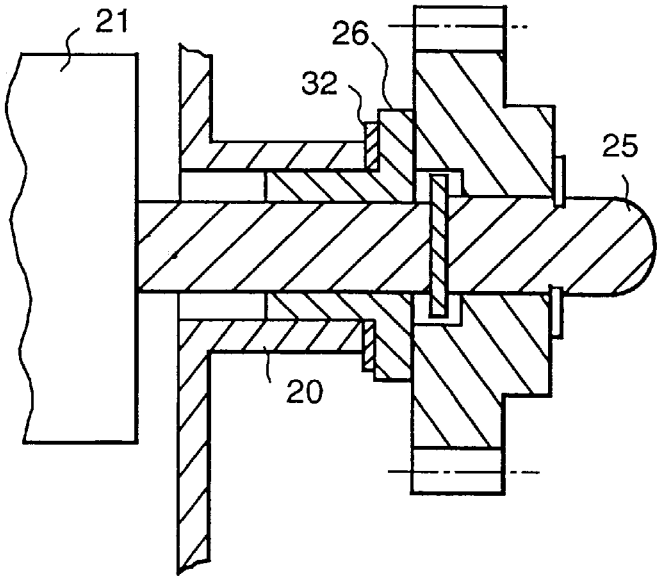
FIG. 4 is a cross-sectional view showing a cleaning brush bearing portion of the cleaning device in accordance with the present invention.

The seal electrode 31, being made of a metal is thin and has an elasticity, and it is fixed to the cover 30, which is also made of an insulating resin, in such a manner as to hold the total length of the upper side of the opening, as shown in FIG. 3. By fixing the cover 30 to the housing 20, the seal electrode 31 is brought in contact with the seal electrode 32 by the elasticity of the seal electrode 32, so as to be supplied with electricity. The seal electrode 31 has a shape such that it extends along the cleaning brush 21 in the inner surface side of the cover 30 and has a gap of T2 and an opposing length of L3 relative to the cleaning brush 21. In this embodiment, the gap T2 is approximately 1 mm, and the length L3 is 10 mm. Therefore, the negatively charged toner floating inside the housing is trapped by the seal electrode 31 while moving toward the opening portion along the rotating direction of the cleaning brush, and does not flow out through the upper side of the opening 15. The seal electrode 33 is fixed to the other end of the opening 15 of the housing with a similar construction as the seal electrode 32 and is supplied with electricity through the seal electrode 31. The seal electrode 33 has a labyrinth dimension L2, as shown in FIG. 2, and the labyrinth prevents the toner from leaking out of the cleaning device.

From the viewpoint of effectively preventing the toner from leaking out of the inside of the cleaning device, each of the seal electrodes in the described embodiment is arranged in a place close to the cleaning brush 21. However, discharge cannot occur between the seal electrodes and the cleaning brush 21 because the electric potential of the seal electrodes is equal to the electric potential of the cleaning brush 21.

In general, the photosensitive body needs to be grounded, and the photosensitive body in this embodiment is grounded by mounting the photosensitive body so that the aluminum vapor deposited layer of the photosensitive body is in contact with the surface of the aluminum drum 3. The seal electrodes are mounted so as to surround the three sides of the opening which faces the photosensitive surface at a distance corresponding to the gap T1. A voltage of approximately 500 Volts is applied to the seal electrodes, and consequently an electric field from the seal electrodes toward the drum is formed with the aluminum vapor deposited layer of the photosensitive body and the aluminum drum 3 serving as the opposite electrode. Most of the residual toner 9 scraped off by rotating contact of the cleaning brush 21 with the photosensitive body is trapped and collected by the cleaning brush 21, to which a voltage of approximately 500 Volts is applied. However, a very small amount of the toner, particularly, the very fine toner tends to fly upward near the contact portion between the photosensitive body and the cleaning brush. This toner flows from the contact portion between the photosensitive body and the cleaning brush toward the seal electrode 31 along the rotating direction of the drum in the down stream side of rotation of the drum, and then the negatively charged toner is captured by the electric field and trapped by the seal electrode 31.

On the other hand, most of the toner flying up on the upstream side of the rotating direction of the drum from the contact portion between the photosensitive body and the cleaning brush is closed in the portion of the opening by the air flow near the drum surface caused by the rotating action of the drum, and at the same time this toner is guided into the housing through the gap in the lower side portion of the opening of the housing by the rotation of the cleaning brush. Due to the above-mentioned observed result, in the present embodiment, no seal electrode is provided in the lower side of the opening, and the seal electrodes are arranged only on the three sides of the opening as described above. The toner flying up in both end portions of the cleaning brush 21 flows out through both sides. Therefore, the toner is trapped by the seal electrode 32 and the seal electrode 33 in a similar manner.

In this embodiment, the residual toner 9 is sufficiently negatively charged by the charger 12, and the electric potential of the photosensitive body is sufficiently made uniform by irradiation with the lamp 13 so that the electric potential of the photosensitive body does not constrain the residual toner 9. Therefore, the toner can be certainly scraped and trapped by the cleaning brush, and the cleaning capability of the cleaning device can be substantially improved by trapping of the toner by the seal electrodes. In this embodiment, the gap T1 is set to approximately 1.5 mm and, consequently, the electric field intensity is approximately 333 V/mm. Therefore, the very fine toner which flows up can be trapped. In general, cleaning devices are consumable articles which are periodically exchanged. In this embodiment, the cleaning device is a consumable article and is exchanged after a predetermined amount of printings has been performed.

Although the seal electrode in the present embodiment is in the form of a thin metallic plate, the same effect can be attained by employing the shape of the housing or the cover as the shape of the electrode, and performing surface treatment, such as local plating, on that portion. Further, the above description has been made by reference to an example in which a photosensitive body is taken as the member to be cleaned. However, in a case where the member to be cleaned is a transfer belt 7*a*, as shown in FIG. 1, the shaft rotatably supporting the transfer belt 7*a* may be used as a grounded member opposite to the seal electrode.

As described above, according to the present invention, it is possible to provide a cleaning device which is capable of certainly preventing the extraneous substances, such as toner, paper particles and so on, from releasing outside the extraneous substance removing region, and an electrophotographic apparatus having the cleaning device.

What is claimed is:

1. A cleaning device for an electrophotographic apparatus comprising a cleaning brush rotatable supported inside a housing, a part of the cleaning brush being exposed out of an opening provided in said housing sufficiently to scrape against a member to be cleaned to remove extraneous substances, including charged toner and paper powder, from said member to be cleaned, wherein said housing is made of an insulating resin, a conductive bearing being attached onto said insulating resin housing, a rotating shaft of said cleaning brush being supported by said conductive bearing, at least one seal electrode positioned opposite to said member to be cleaned is arranged at least in a part of said opening, and a voltage having a reverse polarity to a charged polarity of said extraneous substances is applied to said at least one seal electrode, voltage supply to said cleaning brush being performed through said rotating shaft, and voltage supply to said at least one seal electrode being performed through said conductive bearing.

2. A cleaning device for an electrophotographic apparatus according to claim 1, wherein said at least one seal electrode is arranged on a side parallel to the rotating shaft direction and in the upstream side of rotation of said cleaning brush, among sides composing said opening of the housing, has an electrode surface positioned opposite to said member to be cleaned and an electrode surface arranged on an inner surface of the housing in a shape adjacent to and extending along the surface of the cleaning brush.

3. A cleaning device for an electrophotographic apparatus according to claim 1, wherein a plurality of seal electrodes are provided including seal elcestrodes arranged on sides intersecting the side of the upstream side of rotation of said claeaning brush and which have a labyrinth effect with an end surface of said cleaning brush.

4. A cleaning device for an electrophotographic apparatus according to claim 1, wherein a plurality of seal electrodes are provided and said seal electrodes are arranged on a side parallel to the rotating shaft direction and positioned in the upstream side of rotation of said cleaning brush and on two sides intersecting said side at the both ends of said side composing said opening of the housing.

5. A cleaning device for an electrophotographic apparatus according to claim 1, wherein said member to be cleaned is a movable photosensitive body, and said cleaning device is arranged between a transfer portion and a charging portion of said photosensitive body, and wherein the rotating direction of said cleaning brush is opposite to the moving direction of said photosensitive body in a rubbing portion with said photosensitive body.

6. A cleaning device for an electropuotographic apparatus according to claim 1, wherein the same voltage which is applied to said at least one seal electrode is applied to said cleaning brush.

7. A cleaning device for an electrophotographic apparatus according to claim 1, wherein a voltage having a reverse polarity to a charge polarity of said extraneous substances is applied to said cleaning brush.

* * * * *